US007469447B2

(12) United States Patent
Schlegel

(10) Patent No.: US 7,469,447 B2
(45) Date of Patent: Dec. 30, 2008

(54) VEHICLE HINGE

(75) Inventor: Peter Schlegel, Wuppertal (DE)

(73) Assignee: Edscha AG, Remsheid (DE)

( * ) Notice: Subject to any disclaimer, the term of this patent is extended or adjusted under 35 U.S.C. 154(b) by 0 days.

(21) Appl. No.: 10/699,019

(22) Filed: Oct. 31, 2003

(65) Prior Publication Data

US 2004/0088826 A1 May 13, 2004

(30) Foreign Application Priority Data

Oct. 31, 2002 (DE) ..... 102 50 761

(51) Int. Cl.
*E05D 3/06* (2006.01)

(52) U.S. Cl. ..... 16/366; 16/306; 16/308; 49/248

(58) Field of Classification Search ..... 16/289, 16/370, 286–288, 239, 290, 242, 335, 306, 16/308; 296/146.12, 76, 146.8, 146.11; 49/248–250, 49/340–342, 359, 387, 386; 180/69.2, 69.21; 74/100.1; 241/5; 366/165.5, 173.2; 417/171, 417/194; 210/787, 512.1
See application file for complete search history.

(56) References Cited

U.S. PATENT DOCUMENTS

| | | | | | |
|---|---|---|---|---|---|
| 2,185,214 | A * | 1/1940 | Claud-Mantle | 16/288 |
| 4,429,933 | A * | 2/1984 | Sokolowski | 16/333 |
| 4,502,182 | A * | 3/1985 | Lautenschlager et al. | 16/288 |
| 4,520,977 | A * | 6/1985 | Holzhauser et al. | 248/201 |
| 5,062,182 | A * | 11/1991 | Griffiths et al. | 16/368 |
| 5,339,494 | A * | 8/1994 | Esau et al. | 16/294 |
| 5,544,388 | A * | 8/1996 | Chiura | 16/375 |
| 5,557,829 | A * | 9/1996 | Schoen et al. | 16/375 |
| 6,182,952 | B1 | 2/2001 | Gutierrez | 267/64.11 |
| 6,230,364 | B1 | 5/2001 | Cheal | 16/289 |
| 6,269,521 | B1 * | 8/2001 | Gabel | 16/287 |
| 6,367,123 | B1 | 4/2002 | Cheal et al. | 16/370 |
| 6,499,189 | B2 * | 12/2002 | Kondo et al. | 16/289 |
| 6,618,904 | B1 * | 9/2003 | Nagy | 16/370 |
| 6,736,440 | B1 * | 5/2004 | Hashim et al. | 296/76 |
| 6,804,858 | B2 * | 10/2004 | Yazawa et al. | 16/289 |
| 6,964,316 | B1 * | 11/2005 | Polz et al. | 180/274 |
| 2003/0140454 | A1 * | 7/2003 | Cheal et al. | 16/289 |

FOREIGN PATENT DOCUMENTS

| | | |
|---|---|---|
| DE | 19721941 | 11/1998 |
| DE | 19731507 | 1/1999 |
| DE | 19846600 | 4/1999 |
| DE | 197 55 486 | 6/1999 |
| DE | 19755487 | 6/1999 |
| DE | 10001054 | 6/2001 |
| DE | 20108874 | 9/2001 |
| DE | 20201316 | 6/2002 |
| DE | 10117769 | 10/2002 |

* cited by examiner

*Primary Examiner*—William L. Miller
(74) *Attorney, Agent, or Firm*—Davidson, Davidson & Kappel, LLC

(57) ABSTRACT

A vehicle hinge for coupling a flap to a vehicle body, comprises a first link, a second link, a first spring, wherein one of the first link and the second link are to be arranged pivotably on a body of a vehicle and on a flap of a vehicle, respectively, wherein, when the flap is closed, the first spring pretensions the flap in an opening direction, a tensioning device for tensioning the first spring in a second opening phase of the flap, and a locking device for retaining the tensioned first spring.

33 Claims, 3 Drawing Sheets

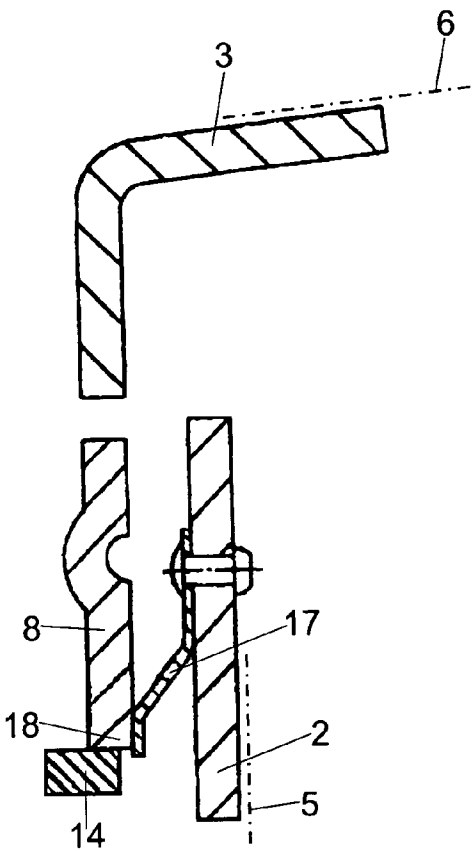
Fig. 5
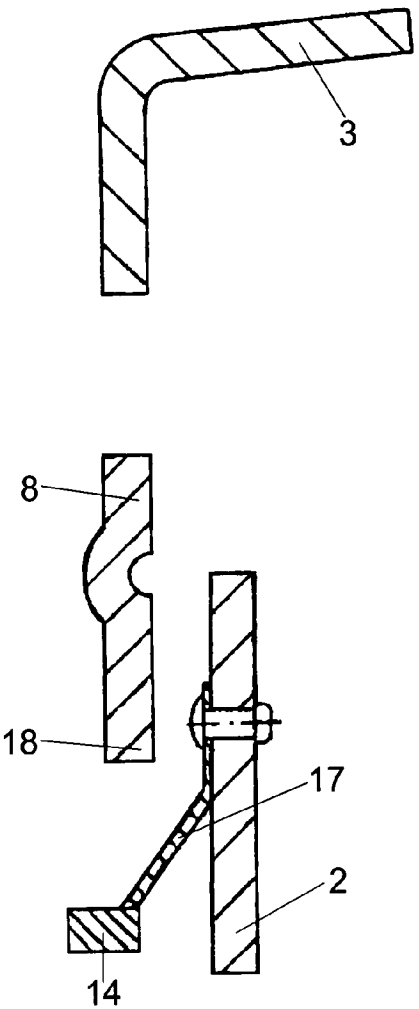
Fig. 4
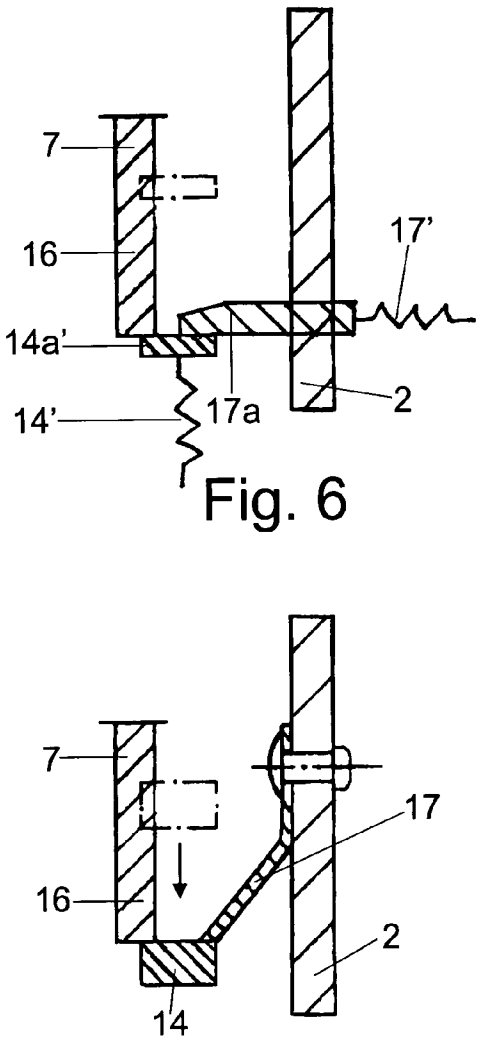
Fig. 6
Fig. 3

VEHICLE HINGE

Priority is claimed to German Patent Application DE 102 50 761.9, filed on Oct. 31, 2002, the entire disclosure of which is incorporated by reference herein.

BACKGROUND

The present invention relates to a vehicle hinge, in particular for coupling a flap to a vehicle body, comprising a first link, a second link and a spring, wherein the first link and the second link are to be arranged pivotably in each case on a body of a vehicle and on a flap of a vehicle, and wherein, when the flap is closed, the spring pretensions the latter in the opening direction.

Single-joint hinges and multiple-joint hinges which have a spring as an opening aid are known from practice. For example, tail flaps which are acted upon by gas-filled compression springs are known, but these are afflicted with a series of drawbacks: the characteristic is severely temperature-dependent and, moreover, it is precisely in the closed position that the force of the gas-filled spring is often not sufficient to push open the flap.

Furthermore, for front flaps, compression springs which are arranged in the region of a hood lock and are released via a lever in the driver's cab are known from practice, but, because of a catch hook, they only lift the front flap for a short distance and then have to be released and guided further by hand.

German patent application DE 197 31 507 A1 describes a plurality of four-joint hinges which are in each case equipped with at least one supporting spring. A problem with all of these hinges is that the considerable opening force which is required for pushing open a tail flap and which, if appropriate, is applied by additional springs has to be overcome again by the user in the end phase of closing the flap, which considerably impairs the ease of operation. Furthermore, the flap is excessively accelerated particularly in the last third of its opening movement, for which reason considerable outlay has to be provided for an end stop.

German patent application DE 197 55 487 A1 describes a vehicle hinge, in which a flap is connected to a body via a four-joint arrangement, the flap being pretensioned in the opening direction with respect to the body under the force of a gas-filled compression spring, the gas-filled compression spring being arranged at its body-side end on an arrangement having a means of adjusting the direction of action in order to improve the poor opening behavior in the initial phase of the opening movement. An arrangement of this type is complicated to install and is costly and in fact entails costs of the same order of magnitude as an electric drive.

German patent application DE 197 21 941 A1 describes a vehicle hinge, in which the flap can be pivoted via a four-joint linkage comprising two links which are mounted pivotably on fastening parts for the flap and the body, where a leaf spring acts in the opening direction upon one of the links. A disadvantage of the known arrangement is that the spring force of the leaf spring has to be overcome by the user when closing the flap, thus limiting the ease of operation.

German Utility Model DE 202 01 316 U1 shows a vehicle hinge of the gooseneck type for a flap, including a gas-filled spring pivotably attached at a first end to the body of the vehicle for supporting the opening movement of the flap. The other end of the gas-filled spring is desplaceably and pivotably supported in a slot of a lever pivotably attached to the body. The lever is coupled to a rod being attached to the flap. The joint of the gas-filled spring changes its position within the slot of the lever depending upon the opening angle of the flap such that the distance to the joint axis of lever and body changes and accordingly induces different forces. This solution is expensive due to the number of parts necessary, and further, the sliding movement in a slot tends to induce noise and wear.

German Utility Model DE 201 08 874 U1 shows a hinge with an arrangement for supporting the opening movement of a part pivotable around one axis, wherein the prestress of a driving spring in a first step urges the pivotable part in an open position. For closing the pivotable part, the drive spring is nearly completely stressed in a first closing movement phase and in a subsequent closing movement phase, the driving spring does nearby not need to be overcome. For this purpose, a pin is guided in an approximately triangular slot, wherein the pin is guided one edge of the triangle in the opening movement and along the two other edges of the triangle in the closing movement.

German patent application DE 198 46 600 A1 shows a four-joint hinge for a flap, wherein the opening movement driven by a gas-filled spring is initially supported by a leaf spring, wherein the leaf spring is arranges on an attachment part assigned to the body of a vehicle and abuts against a roller provided on the attachment part assigned to the flap. Only a brief impulsion for opening is possible, and the force of the leaf spring has to be overcome by tensioning it with closing the flap.

German patent application DE 101 17 796 A1 shows a four-joint hinge for a flap, wherein the opening movement driven by a gas-filled spring is initially supported by a leaf spring formed as a V, wherein a first leg of the leaf spring is arranged on a link of the four-joint hinge and another leg of the leaf spring abuts against an attachment part of the four-joint hinge assigned to the flap. Here too, the the leaf spring has to be tensioned with closing the flap.

German patent application DE 100 01 054 A1 shows a flap drive, wherein the force for driving the flap is generated by a motor, wherein the motor is supported by a first spring and a second spring, these two springs being tensioned by the motor again when the flap is being closed.

SUMMARY OF THE INVENTION

It is an object of the present invention to provide a vehicle hinge which has a pleasant operating characteristic.

It is a further or alternate object of the present invention to provide a vehicle hinge that supports an opening movement of a flap without necessitating additional force for closing the flap.

It is a still further or alternate object of the present invention to provide a vehicle hinge that transforms an excedent energy of a driving unit for a flap in a second opening movement phase to compensate for a spring force opposing the final part of a closing movement of a flap.

It is a still further or alternate object of the present invention to provide a vehicle hinge where a spring supporting an initial opening movement of the flap is locked in a pre-stressed condition again before the flap reaches its complete open position.

It is a still further or alternate object of the present invention to provide a vehicle having a flap, two links for coupling the flap to the vehicle, and a drive unit for operating the flap having a smooth opening and closing movement where a hysteresis is provided between opening and closing forces acting on the flap.

The present invention provides a vehicle hinge for coupling a flap to a vehicle body, comprising a first link, a second link, a first spring, wherein one of the first link and the second link are to be arranged pivotably on a body of a vehicle and on a flap of a vehicle, respectively, wherein, when the flap is closed, the first spring pretensions the flap in an opening direction, a tensioning device for tensioning the first spring in a second opening phase of the flap, and a locking device for retaining the tensioned first spring.

The present invention further provides a vehicle hinge, comprising a first link and a second link for coupling a flap to a vehicle body, a first spring for pretensioning the flap in a closed position into an opening direction during a first opening movement phase of the flap, a drive member tensioning the flap into an opening direction throughout the opening movement of the flap, and a tensioning device for tensioning the first spring in a second opening movement phase of the flap.

The present invention still further provides a vehicle hinge, comprising a first link and a second link for coupling a flap to a vehicle body, a first spring for pretensioning the flap in a closed position of the flap into an opening direction during a first opening movement phase of the flap, and a tensioning device for tensioning the first spring against a pretension of the first spring in a second opening movement phase of the flap, such that before a completely open flap is reached, the first spring is pressed back into its starting position by the tensioning device.

The present invention still further provides a vehicle, comprising a vehicle body, a flap, a four-joint flap hinge comprising a first link and a second link, the first link and the second link each being pivotably attached to the vehicle body and to the flap, a gas-filled spring assigned to the vehicle body and to the flap, and a first spring arranged on the vehicle body, the first spring being in a tensioned position when the flap is closed and urging the flap into an opening direction, wherein one of the first link and the second link comprises a portion coming into contact with said first spring in a second opening phase of the flap and tensioning the first spring back into said tensioned position.

The vehicle hinge according to the invention defines a four-joint arrangement, by means of which the flap is coupled to the body of a vehicle, the spring accelerating the flap out of the closed position and therefore shifting it into an open position, in which, for example, a gas-filled spring or other supporting means, even motorized means, can be effective in order to open the flap. In order to avoid overcoming the spring force when closing the flap and therefore to increase the ease of operation, the vehicle hinge according to the invention is provided with a tensioning device which, during a second opening phase of the flap, again tensions the spring, which has initially accelerated the flap upward out of the closed position. Moreover, the tensioning of the spring in a second opening phase of the flap, preferably at an angle with respect to the closed position of more than 30° and, in particular, of more than 50°, has the advantageous effect of braking the movement of the flap a little and of using the excess force or stored energy which is not required for shifting the flap in order to tension the spring. Furthermore, the vehicle hinge according to the invention provides a locking device for retaining the tensioned spring in order, firstly, to avoid the spring causing an acceleration in the closing phase, which corresponds to the second opening phase of the flap, and, furthermore, the spring having to be tensioned again when the flap reaches a position close to the closed position. This significantly increases the ease of operation of the flap, in particular if a motorized drive is not provided. Furthermore, the sequence of movement of the flap makes a harmonious impression on an observer.

In principle, the vehicle hinge according to the invention can be produced by the first link and the second link being fastened in each case directly in the body and in the flap and being mounted pivotably there. Expediently, however, each of the two links is mounted pivotably at the one end in a fastening part assigned to the body and at the other end in a fastening part assigned to the flap, so that a four-joint hinge which is already completed can be supplied as a preassembled unit and can be fastened onto the flap or body. It has to be understood that, in order to compensate for tolerances, openings, such as holes or slots, can be provided in the fastening part. It is similarly possible to provide a separate fastening part in each case for each end of the two links or to provide one of the links not only in a manner such that it pivots, but also such that it can be displaced in a slot.

The spring which accelerates the flap is preferably designed as a leaf spring which can be arranged either on the body or on the flap or on one of the fastening parts or on one of the links in such a manner that the flap, after it has been released, obtains an initial acceleration in the opening direction. The leaf spring is expediently arranged in the region of the links because the active point of the spring is provided there close to the actual and the virtual pivot points of the hinge and of the pivotably mounted links, and, in spite of a lever arm which is short in comparison to the length of the flap, brings about, owing to the angular position of the flap, a large path of acceleration, which is different from how it would be if the spring would be arranged in a distal region with respect to the hinges, e.g. in the region of a flap lock. In particular, provision is preferably made for the spring to be arranged outside a flap lock.

According to another preferred refinement, the spring accelerating the flap is designed as a compression spring which is preferably coupled to a supporting part which transmits the spring force to the accelerated part of the flap or of the hinge. A different spring which acts directly or indirectly on the accelerated flap part is also possible.

A refinement of the vehicle hinge is particularly preferred, in which the spring acts upon the first or the second link, thus resulting in a moment about the joint thereof. It has to be understood that a dedicated spring may also be assigned to both links independently of each other, said spring optionally being fixed to the link and pushing against a body or flap or against a corresponding fastening part. The design of the spring as a leaf spring advantageously makes it possible for the spring shape to be matched to the design of the vehicle hinge without the energy which is retained in this energy store when the leaf spring is pretensioned being disadvantageously reduced. Moreover, the provision of a leaf spring makes it possible for the leaf spring to be designed in such a manner that it has more than just one supporting point for a part of the hinge which is to be accelerated; in particular, an appropriate design can be used to provide a contact surface with both links, and, moreover, a leaf spring provides a sufficient extent in order to provide a tensioning device outside the point which, for the acceleration of the flap, bears against the corresponding part of the vehicle hinge. However, a leaf spring is preferably provided with just one convolution which projects in the direction of an acted-upon part of the vehicle hinge, said leaf spring bearing against a corresponding region of the acted-upon part in the region of this convolution where it transmits the force to the part or the moment about the pivoting joint.

The spring preferably acts in the opening direction of the flap upon the longer of the two links, in particular in a region which is further away from the coupling of the link. This makes a more favorable moment possible given a correspondingly dimensioned leaf spring. Moreover, during the opening of the flap, the longer link advantageously executes a movement essentially only in one direction of rotation, at least over the first half of the pivoting of the flap. If the four-joint linkage is configured in such a manner that one of the links pivots to and fro during the opening movement, the same side of a link of this type may also be used in order to tension the spring.

According to a preferred refinement of the invention, before the flap reaches the completely open position, the spring is pressed back into its starting position or even beyond it by the tensioning device and is held in a tensioned position by the locking device. This second opening phase, in which the spring is tensioned again, preferably takes place over an angular range of approximately 30°, with the result that the excess force of, for example, a gas-filled spring is used over a larger angular range in order to tension the spring.

The tensioning device is preferably provided on one of the two links which, owing to the flap being displaced, execute a pivoting movement. If the flap executes, for example, a pivoting movement of approximately 120° between the closed position and open position, a corresponding pivoting movement of the two links in a four-joint hinge takes place about part of the corresponding angle of the hinge. The hinge which is only pivoted in one direction in the course of the pivoting movement of the flap in the opening direction is expediently used as a tensioning device by a projecting portion of the link expediently being arranged in the region in which it is coupled to the fastening part on which the spring is arranged, said portion not being directed toward the spring in the closed position, but, owing to the opening movement of the flap, being rotated toward the spring in the manner of an eccentric and therefore tensioning the spring. This portion is preferably provided close to the coupling of the link about the fastening part in which the spring is fixed, preferably on the shorter link, in order thereby to define a favorable lever ratio. As an alternative, it is possible, for this purpose, to couple a lever to one of the two links or to lower a base supporting the spring. A roller can preferably be arranged in the region of the projecting portion of the link, said roller facilitating the displacement in the direction of the main extent of the link, which results owing to the pivoting movement of the link, and suppressing production of noise. It is furthermore possible to provide a slit in the region of the spring designed as a leaf spring, into which, after the leaf spring is tensioned and locked, the projection can penetrate during further pivoting of the flap.

A particularly favorable arrangement for tensioning the spring is achieved by the tensioning device being arranged on the other link which is not acted upon in the opening direction by the spring when the flap is closed, with the result that the lever ratios can be set differently in relation to the spring. Furthermore, provision is preferably made for the coupling of the other lever or for that region of the link which protrudes over the coupling of this link to define an end stop for the spring when the latter has used, for example, the region of its convolution to accelerate the acted-upon link. In a design of this type, it is possible, in a particularly simple manner, to assign a dedicated spring in each case to both links, said spring being tensioned by the other link in each case, the vehicle hinge then preferably being configured in such a manner that the tensioning of the two springs is provided at least partially offset in time and/or partially combined. In particular, a spring can then be fastened to the flap-side fastening part and a spring can be fastened to the body-side fastening part, specifically in a region in which the two links are arranged adjacent to each other in the closed position of the flap, in which case a region of the one link which is situated further away from the corresponding coupling is acted upon by the corresponding spring, and this spring is tensioned again by a region arranged close to the corresponding coupling of the other link.

The locking device for the spring which is pushed back by the tensioning device into or beyond its starting position is preferably designed as a second spring. This second spring can have a substantially lower spring force than the spring which accelerates the flap, it being necessary to ensure that the locking spring holds back the tensioned spring to the greatest possible extent. As an alternative, it is possible to provide, for the locking, a spring-actuated ram which can be displaced transversely with respect to the opening movement of the flap. Instead of the locking the completely tensioned spring, the spring may alternatively be retained in each case, for example via a ratchet element, in increasingly locked positions of the spring following short increments of the tensioning. An arrangement of this type has, in particular, the advantage that, if the opening movement of the flap is broken off before the end position is reached and the flap is closed again, the spring is already tensioned to a certain extent and therefore the spring force which is to be overcome before the flap is closed is correspondingly reduced. When the spring is designed as a rotatable spring, the rotary movement required for tensioning can be produced by one of the links, for example via a bevel gear mechanism.

Means are expediently provided for releasing the locking arrangement before the next opening of the flap, said means preferably only lifting the locking device when the flap has been arranged and preferably locked in a closed position. This ensures that the spring is not released earlier than before the flap is closed, and therefore the spring force does not have to be overcome again by an operator.

It is preferable for one of the links to be provided as the release means, which, during the pivoting into the closed position, lifts up or displaces the locking device or keeps it in the displaced position while the spring again comes to bear against that part of the vehicle hinge which is to be accelerated. A section of one of the links is preferably provided as the release means, said section only having to transmit a small force in order to displace the weak locking device, if the latter is designed as a spring, and therefore, in particular, only becoming effective in the closed position of the flap. The link involved here is preferably the acted-upon link. As an alternative, it is possible to couple the means for release to the lock of the flap, as a result of which the locking device is only released or lifted up when the flap lock has snapped into place or at a defined unblocking of the flap.

The vehicle hinge is expediently equipped with a further spring, preferably a gas-filled spring, which essentially causes the opening movement of the flap and can be pivotably arranged either on the body and flap or else on one of the fastening parts. When the front hood is closed, gas-filled compression springs of this type are generally not sufficient, due to the unfavorable effective lever, to accelerate a flap out of the closed position, but deploy a sufficient force when the flap is partially open. The further spring is the drive unit that imparts the force for pivoting the flap along its complete opening path or angular range, and further generates the force to tension the first spring. As an alternative drive unit, a motorized drive, for example an electric drive or a hydraulic drive, may also be provided.

Further features and advantages of the present invention will emerge from the embodiment described below.

BRIEF DESCRIPTION OF THE DRAWINGS

Preferred exemplary embodiments of a vehicle hinge according to the invention are described below and explained in greater detail with reference to the attached drawings.

FIG. 3 shows a section through the vehicle hinge from FIG. 1 along the line III—III when the hinge is open as in FIG. 2.

FIG. 4 shows the section according to FIG. 3 when the flap is slightly open, as in FIG. 1.

FIG. 5 shows the section according to FIG. 3 when the flap is closed, as in FIG. 1.

FIG. 6 shows a section comparable to FIG. 3 through a further exemplary embodiment of a vehicle hinge according to the invention.

DETAILED DESCRIPTION OF A PREFERRED EMBODIMENT

Figure 1:
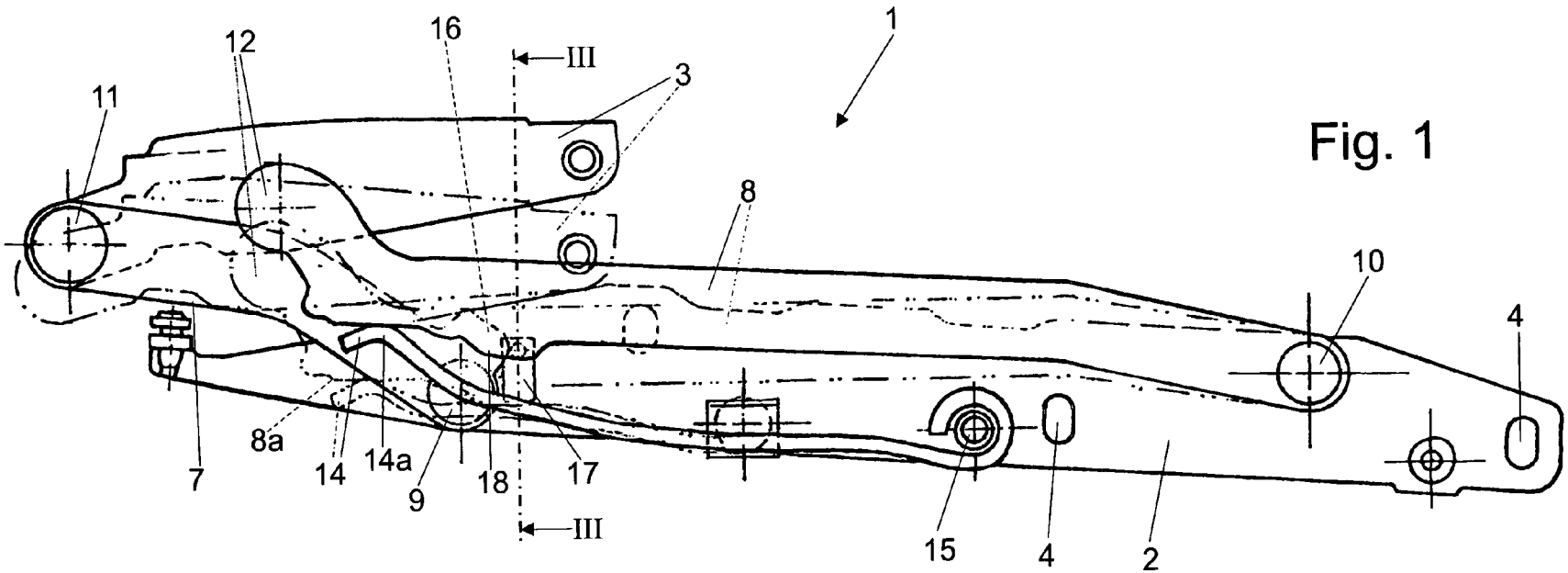
FIG. 1 shows a side view of a preferred exemplary embodiment of a vehicle hinge according to the invention with a closed or slightly open flap.
Figure 2:
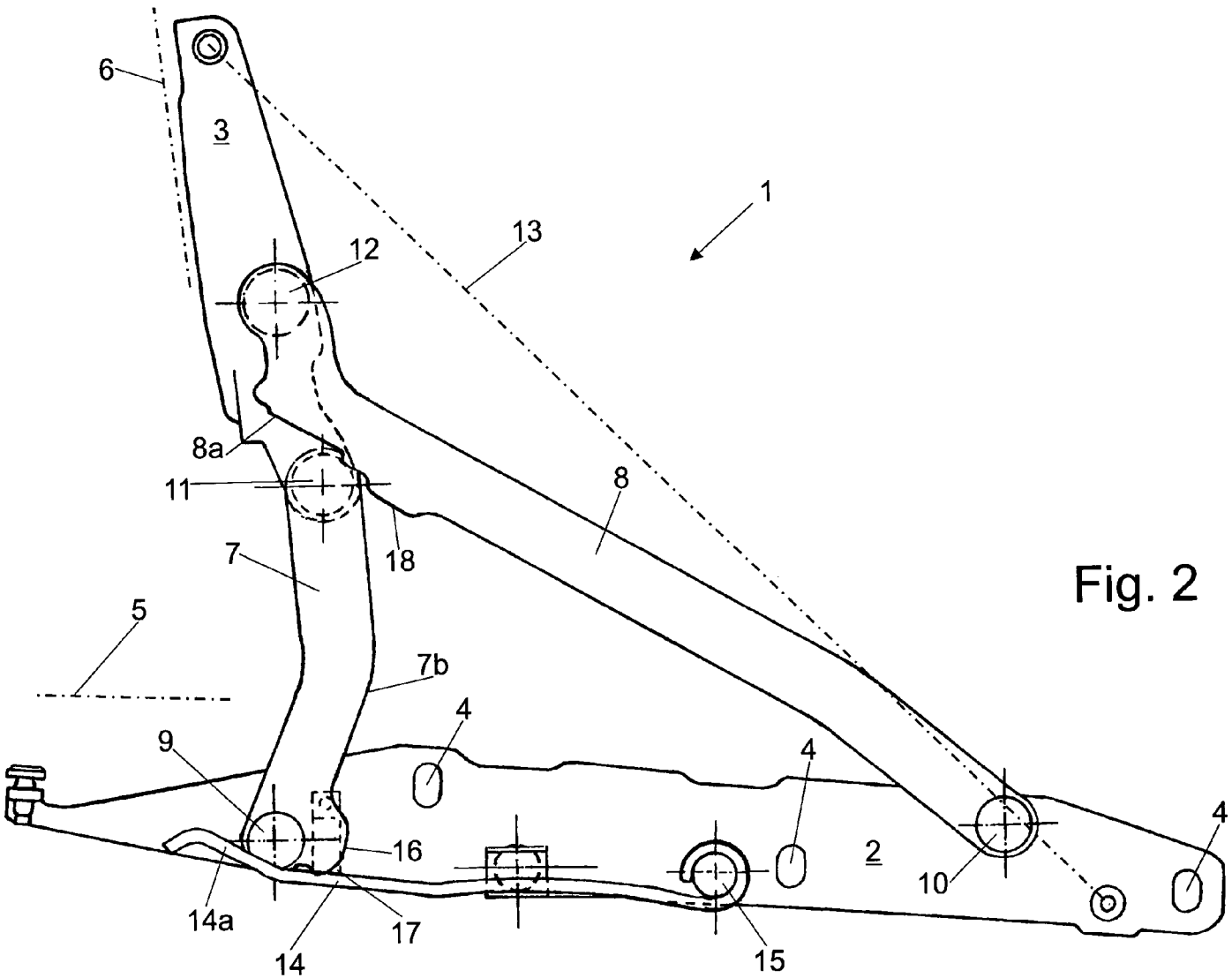
FIG. 2 shows the vehicle hinge from FIG. 1 with an open flap.

FIGS. 1 and 2 show a vehicle hinge 1 which is designed as a four-joint hinge, is provided for the coupling of a trunk lid or a tail flap and which pivots the trunk lid from an essentially horizontal closed position into an open position which is offset by approximately 115° with respect to the horizontal position.

The vehicle hinge 1 has a body-side fastening part 2 and a flap-side fastening part 3 which can be fixed on the body and on the flap, respectively, via corresponding bores 4. The body is indicated in FIG. 2 by a chain-dotted line 5, the flap is indicated in FIG. 2 by a chain-dotted line 6.

The body-side fastening part 2 and the flap-side fastening part 3 are connected via a short link 7—which is at the rear with respect to the virtual pivot point and a long link 8 in corresponding pivoting joints 9, 10, 11, 12, the shorter link 7 and the longer link 8 being designed in a manner such that they can pivot past each other and having a design which differs from the ideal connecting line between the joints. The body 5 and the flap 6 are furthermore connected to each other via a gas-filled compression spring 13, defining a drive unit for the vehicle hinge 1 and which is indicated by a chain-dotted line 13 in FIG. 2 where it can be seen that the two ends of the gas-filled compression spring 13 are likewise arranged on the fastening parts 2, 3. It has to be understood that the links 7, 8 and the gas-filled compression spring 13 may be arranged outside fastening parts 2, 3, in particular may be arranged directly on the body 5 and on the flap 6.

Furthermore, a first spring 14 which is designed as a leaf spring is fixed on the body-side fastening part 2 at a fixing point 15, said spring having, in its end facing away from the fixing point 15, an upwardly projecting convolution 14*a* which, when the vehicle hinge 1 is closed, bears with its upper side against a rear side 8*a* of the longer link 8. It can be seen that the convolution 14*a* bears in a region of the link 8 which is remote from the pivoting joint 10, with the result that a favorable lever ratio is set. The projecting convolution 14*a* bears essentially with its projection against the rear side 8*a* of the link 8.

The spring 14 is designed in such a manner that it accelerates the flap 6 during an initial pivoting, but, in particular, cannot be displaced in the opening direction over the entire pivoting path of the flap 6; it is therefore not a spring which corresponds to the gas-filled compression spring 13 although it could itself be designed as a gas-filled compression spring. The spring 14, on account of its pretensioning, accelerates the flap upward via the second link 8, the spring 14 itself being relaxed over a distance corresponding to approximately 8° of the flap angle, it being possible for this value to be set in a range of between 2° and 12° by configuration of the spring 14. The acceleration of the spring 14 assists the opening of the flap 6 up to a flap angle of approximately 16°, it being possible for values of up to 24° to be set as a function of the spring and the tensioning energy, and preferably at least 10° being provided.

The link 7 has, on one side 7*b* which lies opposite the spring 14 in the closed position of the flap 6, a projecting portion 16 which is disengaged from the spring 14 when the flap is closed, but, as the flap 6 opens, gradually comes to bear against a flat region of the spring 14 situated between the convolution 14*a* and the fixing 15 and tensions the latter at least back into its starting position when the flap 6 is further opened during a second opening phase, and in this manner defines a tensioning device. In the present vehicle hinge 1, the second opening phase runs in an angular range of between 45° and 85° with respect to the horizontal closed position. The short link 7 is bent out in the direction of its side 7*b*, so that contact in the region of the convolution 14*a* when the flap is closed is avoided.

In the region of contact of the spring 14 and the projecting portion 16 of the shorter link 7, a second spring. 17 is arranged on the body-side fastening part 2, said second spring being pretensioned in the direction of the path of displacement of the first spring 14 and, in the present case, likewise being designed as a short leaf spring. This second spring 17 can therefore be displaced flexibly in the direction of the body-side fastening part 2, but, in the direction of displacement of the leaf spring 14, forms a virtually inflexible stop which cannot be overcome, and thereby defines a reliable locking device.

A lug 18 which protrudes in the direction of the body-side fastening part 2 is provided on the long link 8 and, when the vehicle hinge 1 is closed, is arranged in the region of the second spring 17. As can be seen in particular in FIG. 5, which shows the flap 6 in the closed state, the second spring 17 is displaced by the lug 18 of the longer link 8 as the flap 6 is being closed, with the result that the spring 14 can again act on the longer link 8.

FIG. 6 shows, in an illustration corresponding to FIG. 3, a modified embodiment of a vehicle hinge according to the invention. In this case, the same reference numbers as in FIGS. 1 to 5 refer to the same or comparable parts. Instead of a leaf spring 14, a compression spring 14' is provided which pretensions a supporting section 14*a*' which is arranged pivotably on the fastening part 2, in the opening direction, it also being possible for the supporting section 14*a*' to be coupled to the fastening part 2 via a multiple-joint arrangement. A locking device comprises a further compression spring 17' and a ram 17*a* which is guided axially in the fastening part 2 and, during closure of the flap 6, is made contact with by the long link 8 in the region of its tip, which is of wedge-shaped design, and is disengaged from the supporting section 14*a*' lying beneath it counter to the force of the compression spring 17'. It is also possible to axially guide the supporting section 14*a*' and/or to connect the ram 17*a* in an articulated manner to the fastening part 2.

The present invention functions as follows:

Starting from a closed flap 6, the vehicle hinge 1, which is designed as a four-bar linkage, is in the position shown by chain-dotted lines in FIG. 1, and the spring 14 and the convolution 14*a* bear against the rear side 8*a* of the long link 8, the second spring 17 releasing the spring 14, so that the latter exerts a pretension on the link 7 in the opening direction of the flap. If the flap 6 is released, the first spring 14 presses the hinge into the position shown in FIG. 1 in solid lines, as a result of which, in the illustration according to FIG. 1, the link 7 and the link 8 are pivoted clockwise about the pivoting links 9 and 10 while the fastening part 3, together with the flap 6 fastened on it, pivots upward in the anticlockwise direction.

It can be seen that the short link 7 is arranged in the rear region of the flap-side fastening part 3, as a result of which the maximum opening angle of the flap 6 is larger because the fastening part 3 which is arranged in the rear region of the flap 6, is at the same time shifted forward, together with the flap 6, to some extent during the opening movement, as a result of which the rear edge is the point of the flap 6 which is situated furthest forward in the position of the flap 6 in which it is open to the maximum. It can furthermore be seen that a stop 19 is provided on the long link 8 in the region of the coupling 12, said link suppressing the further pivoting movement between the flap-side fastening part 3 and the links 8 and 7 and therefore defining an end position for the opening path of the flap 6.

Starting from the partially opened position of the vehicle hinge 1 which is shown by solid lines in FIG. 1, the further opening movement is brought about by the gas-filled compression spring 13 while the first spring 14 is completely relaxed. This achieves a continuous sequence of movement which runs without an interruption, step or pause during disturbance-free operation, in which case the initial acceleration is produced by the first spring 14 and the further opening movement is produced by the gas-filled compression spring 13 (or, in the case of a motorized drive, also by the latter).

During the further course of the opening movement, the projecting portion 16 of the short link 7 comes into contact during the second opening phase with a region of the spring 14 which lies opposite the convolution 14*a* in relation to the coupling 9, and gradually tensions said first spring back into the starting position which is shown by chain-dotted lines in FIG. 1. The interaction of the projecting portion 16 and of the spring 14 is shown in FIG. 2 and in FIG. 3. As soon as the spring 14 is tensioned beyond the position illustrated in FIG. 1 by chain-dotted lines, the second spring 17 moves forward in the direction of the short link 7 and therefore arrests the spring 14 in respect of its upwardly directed movement. At the same time, the tensioning of the spring 14 via the projecting portion 16 causes the opening movement of the flap 6 to be braked somewhat on account of the pretension of the gas-filled compression spring 13. Owing to the short distance of the portion 16 from the pivoting joint 9, the lever is favorable for tensioning the spring.

If the flap 6 is subsequently closed, the two links 7 and 8 pivot back into their starting positions. Owing to the spring 14 being held by the second spring 17, said first spring 14 no longer comes to stop against the long link 8, as a result of which the spring force of the first spring 14 no longer has to be overcome for the flap to be closed, and the ease of operation is increased. As can furthermore be seen in FIGS. 4 and 5, the long link 8 pivots downward between the short link 7 and the body-side fastening part 2 during closure of the vehicle hinge 1, the lug 18 of the link 8 striking against the second spring 17 and displacing the latter laterally. In this manner, when a closed flap is achieved, the first spring 14 is released again, so that the convolution 14*a* comes to bear against the side 8*a* again, and the vehicle hinge 1 is in the starting position shown by chain-dotted lines in FIG. 1. As indicated in the drawings, it is not necessary for the lug 18 of the link 8 to come to bear against the first spring 14; on the contrary, it is sufficient if the second spring 17 is displaced and then the convolution 14*a* of the spring 14 bounces up again for a short distance.

The invention has been described above with reference to a four-joint hinge, in which the first spring 14 which acts upon the vehicle hinge 1 in the opening direction is designed as a leaf spring and acts on one of the two links. It has to be understood that the selection of a different spring shape, for example a leg spring or a click spring, or of any other spring type or energy storing member is possible. Thus, an elastically deformable backing part, for example a foamed mass, may also be provided as the energy store corresponding to a spring. Further, it is also possible for part different from a link of the vehicle hinge 1 to be acted upon by the first spring, or to bear the first spring to a part different from the attachment part assigned to the body of the vehicle.

It further has to be understood that the locking device 17, which is designed as a leaf spring, and the first spring 14 can also be tensioned and released by means which are not associated with the movement of the links. In particular, the pivoting movement of one of the links can be converted into a tensioning movement via a crank mechanism.

What is claimed is:

1. A vehicle hinge for coupling a flap to a vehicle body of a vehicle, comprising:

a first link, a second link, a first spring, wherein the first link and the second link are each to be respectively arranged pivotably on the vehicle and on the flap of the vehicle, wherein, when the flap is closed, the first spring pretensions the flap in an opening direction, wherein, starting from a closed position of the flap, the vehicle hinge opening movement comprises a first opening phase of the flap and a second opening phase of the flap subsequent to said first opening phase of the flap, a tensioning device tensioning the first spring in the second opening phase of the flap, and a locking device retaining the tensioned first spring.

2. The vehicle hinge as claimed in claim 1, wherein the first link and the second link are pivotably mounted in a first fastening part assigned to the body, and wherein the first link and the second link are pivotably mounted in a second fastening part assigned to the flap.

3. The vehicle hinge as claimed in claim 1, wherein the first spring is designed as a leaf spring, and wherein the leaf spring acts upon one of the first link and the second link for pretensioning the flap.

4. The vehicle hinge as claimed in claim 3, wherein the leaf spring has a convolution projecting in a direction of the link upon which the leaf spring acts and, when the flap is closed, bears in the region of the convolution against the acted-upon link.

5. The vehicle hinge as claimed in claim 3, wherein the leaf spring acts upon the longer of the first link and the second link for urging the flap in the opening direction.

6. The vehicle hinge as claimed in claim 3, wherein the acted-upon link shows, in a coupling region with the body, a projecting section for tensioning the leaf spring when the link upon which the leaf spring acts is provided, wherein the projecting section is a part of the tensioning device.

7. The vehicle hinge as claimed in claim 1, wherein the shorter of the first link and the second link includes the tensioning device for tensioning the first spring in a region of its body-side coupling.

8. The vehicle hinge as claimed in claim 1, wherein, before a completely open flap is reached, the first spring is pressed back into its starting position by the tensioning device, and wherein the locking device holds the first spring in a locked position when the flap is lowered.

9. The vehicle hings as claimed in claim 1, wherein the locking device includes a second spring pretensioned in a direction of a path of displacement of the first spring, and wherein the second spring forms a stop in the direction of the path of displacement of the spring.

10. The vehicle hinge as claimed in claim 1, further comprising means for releasing the locking device before a subsequent opening of the flap.

11. The vehicle hinge as claimed in claim 10, wherein the release means disengages the locking device after a predetermined position of the flap, preferably the closed position of the flap, is reached.

12. The vehicle hinge as claimed in claim 10, wherein one of the first link and the second link is pretensioned by the first spring, and wherein the release means are arranged on said pretensioned link.

13. The vehicle hinge as claimed in claim 10, wherein the release means is defined by a portion of one of the first link and the second link, said portion protruding to define a lug.

14. The vehicle hinge as claimed in claim 1, further comprising a drive unit for driving the vehicle hinge over the complete movement in at least one of the opening direction and a closing direction.

15. The vehicle hinge as claimed in claim 14, wherein the drive unit is a gas-filled spring pretensioning the flap in the opening direction.

16. The vehicle hinge as claimed in claim 1, wherein a section assigned to the first spring is in contact with the second link when the flap is in the closed position, and wherein a section assigned to the first spring is in contact with the first link when the flap is in an at least partially open position.

17. The vehicle hinge as claimed in claim 1, wherein the first spring is pivoted as it relaxes corresponding to a flap angle of between 2° and 12°.

18. The vehicle hinge as claimed in claim 1, wherein an opening movement brought about by an initial acceleration of the first spring merges continuously without a step into an opening movement brought about by a gas-filled compression spring.

19. The vehicle hinge as claimed in claim 1, wherein the first spring is out of contact with the flap, with the first link and with the second link during a part of the opening movement of the flap.

20. A vehicle hinge, comprising:

a first link and a second link coupling a flap to a vehicle body, a first spring pretensioning the flap in a closed position into an opening direction during a first opening movement phase of the flap, a drive member tensioning the flap into an opening direction throughout the opening movement of the flap, and a tensioning device tensioning the first spring a second opening movement phase of the flap.

21. The vehicle hinge as claimed in claim 20, wherein the drive member is a gas-filled spring.

22. The vehicle hinge as claimed in claim 20, further comprising a locking device for retaining the first spring tensioned in the second opening movement phase.

23. The vehicle hinge as claimed in claim 22, wherein, before a completely open flap is reached, the first spring is pressed back into its starting position by the tensioning device, and wherein the locking device holds the first spring in a locked position when the flap is lowered.

24. The vehicle hinge as claimed in claim 23, further comprising means for releasing the locking device before a subsequent opening of the flap.

25. The vehicle hinge as claimed in claim 20, wherein the first spring is a leaf spring acting upon one of the first link and the second link for pretensioning the flap.

26. The vehicle hinge as claimed in claim 25, wherein the link upon which the leaf spring acts is pretensioned by the first spring in the opening direction of the flap only during the first opening movement phase of the flap.

27. A vehicle hinge, comprising:

a first link and a second link coupling a flap to a vehicle body, a first spring tensioning the flap into an opening direction while the flap is closed, and wherein, starting from a closed position of the flap, the vehicle hinge opening movement comprises a first opening phase of the flap and a second opening phase of the flap subsequent to said first opening phase of the flap a tensioning device tensioning the first spring against a pretension of the first spring in the second opening phase of the flap, such that before a completely open flap is reached, the first spring is pressed back into its starting position by the tensioning device.

28. The vehicle hinge as claimed in claim 27, further comprising a locking device for retaining the first spring tensioned in the second opening phase and when the flap is lowered.

29. The vehicle hinge as claimed in claim 28, further comprising means for releasing the locking device before a subsequent opening of the flap.

30. The vehicle hinge as claimed in claim 29, wherein one of the first link and the second link is pretensioned by the first spring, and wherein the release means is arranged on said pretensioned link.

31. A vehicle, comprising:

a vehicle body, a flap, a four-joint flap hinge comprising a first link and a second link, the first link and the second link each being pivotably attached to the vehicle body and to the flap, a gas-filled spring assigned to the vehicle body and to the flap, and a first spring arranged on the vehicle body, the first spring being in a tensioned position when the flap is closed and urging the flap into an opening direction, wherein, starting from a closed position of the flap, the vehicle hinge opening movement comprises a first opening phase of the flap and a second opening phase of the flap subsequent to said first opening phase of the flap, wherein one of the first link and the second link comprises a portion coming into contact with said first spring and tensioning the first spring back into said tensioned position in the second opening phase of the flap.

32. The vehicle according to claim 31, wherein one of the first link and the second link is pretensioned by the first spring for urging the flap into the opening direction, and wherein the pretensioned link also comprises the portion for tensioning the first spring back into said tensioned position.

33. The vehicle according to claim 32 further comprising a locking device for retaining the first spring in said tensioned position, such that the first spring is kept unreleased when the flap is lowered.

* * * * *